US009472367B2

(12) United States Patent
Mills et al.

(10) Patent No.: US 9,472,367 B2
(45) Date of Patent: Oct. 18, 2016

(54) ELECTRICAL SWITCHING APPARATUS AND RELAY INCLUDING A FERROMAGNETIC OR MAGNETIC ARMATURE HAVING A TAPERED PORTION

(71) Applicant: Labinal, LLC, Denton, TX (US)

(72) Inventors: Patrick W. Mills, Bradenton, FL (US); James M. McCormick, Bradenton, FL (US); Richard G. Benshoff, Sarasota, FL (US); Robert J. Innes, Sarasota, FL (US)

(73) Assignee: LABINAL, LLC., Denton, TX (US)

( * ) Notice: Subject to any disclaimer, the term of this patent is extended or adjusted under 35 U.S.C. 154(b) by 0 days.

(21) Appl. No.: 14/406,551

(22) PCT Filed: Feb. 27, 2013

(86) PCT No.: PCT/US2013/027857

§ 371 (c)(1),
(2) Date: Dec. 9, 2014

(87) PCT Pub. No.: WO2013/187948

PCT Pub. Date: Dec. 19, 2013

(65) Prior Publication Data

US 2015/0187525 A1 Jul. 2, 2015

Related U.S. Application Data

(60) Provisional application No. 61/657,926, filed on Jun. 11, 2012.

(51) Int. Cl.
*H01H 67/02* (2006.01)
*H01H 50/24* (2006.01)
(Continued)

(52) U.S. Cl.
CPC ..... *H01H 50/24* (2013.01); *H01F 7/122* (2013.01); *H01F 7/14* (2013.01); *H01H 50/42* (2013.01);
(Continued)

(58) Field of Classification Search
CPC ..... H01F 7/122; H01F 7/14; H01H 51/27; H01H 51/01; H01H 51/2272; H01H 50/24; H01H 50/42; G06F 3/0601; G06F 3/0625
USPC ..... 335/128, 181, 203, 276
See application file for complete search history.

(56) References Cited

U.S. PATENT DOCUMENTS 4,286,244 A * 8/1981 Schuessler et al. ..... 335/230
4,695,813 A * 9/1987 Nobutoki et al. ..... 335/78
(Continued)

FOREIGN PATENT DOCUMENTS

| | | |
|---|---|---|
| EP | 1258897 | 11/2002 |
| FR | 2790593 | 9/2000 |
| GB | 986918 | 3/1965 |

OTHER PUBLICATIONS

International Search Report filed in PCT/US2013/027857 mailed Jun. 26, 2013.

*Primary Examiner* — Bernard Rojas
(74) *Attorney, Agent, or Firm* — Rankin, Hill & Clark LLP

(57) ABSTRACT

An electrical switching apparatus includes a ferromagnetic frame having first and opposite second portions, a ferromagnetic core disposed therebetween, a permanent magnet disposed on the first portion, a first tapered portion on the opposite second portion; a coil disposed about the core; and a ferromagnetic or magnetic armature including a first portion, an opposite second portion and a pivot portion pivotally disposed on the core between the portions of the armature. The armature opposite second portion has a complementary second tapered portion therein. In a first armature position, the armature first portion is magnetically attracted by the permanent magnet and the first and second tapered portions are moved apart with the coil de-energized. In a second armature position, the armature opposite second portion is magnetically attracted by the opposite second portion of the frame and the first tapered portion is moved into the second tapered portion with the coil energized.

17 Claims, 8 Drawing Sheets

(51) Int. Cl.

| | |
|---|---|
| ***H01F 7/122*** | (2006.01) |
| ***H01F 7/14*** | (2006.01) |
| ***H01H 50/42*** | (2006.01) |
| ***H01H 51/01*** | (2006.01) |
| ***H01H 51/22*** | (2006.01) |
| ***H01H 51/27*** | (2006.01) |
| *H01H 50/16* | (2006.01) |
| *H01H 50/26* | (2006.01) |
| *H01H 50/40* | (2006.01) |
| *H01F 7/08* | (2006.01) |

(52) U.S. Cl.

CPC ..... *H01H 51/01* (2013.01); *H01H 51/2272* (2013.01); *H01H 51/27* (2013.01); *H01F 2007/086* (2013.01); *H01H 50/163* (2013.01); *H01H 50/26* (2013.01); *H01H 50/40* (2013.01)

(56) References Cited

U.S. PATENT DOCUMENTS

| | | | | |
|---|---|---|---|---|
| 4,747,010 | A * | 5/1988 | Bayer | 361/210 |
| 6,670,871 | B1 * | 12/2003 | Saso et al. | 335/78 |
| 2009/0219120 | A1 * | 9/2009 | Abe et al. | 335/203 |

* cited by examiner

ELECTRICAL SWITCHING APPARATUS AND RELAY INCLUDING A FERROMAGNETIC OR MAGNETIC ARMATURE HAVING A TAPERED PORTION

CROSS REFERENCE TO RELATED APPLICATION

This application claims the benefit of U.S. Provisional Patent Application Ser. No. 61/657,926, filed Jun. 11, 2012, which is incorporated by reference herein.

BACKGROUND

1. Field

The disclosed concept pertains generally to electrical switching apparatus and, more particularly, to relays, such as, for example, aircraft relays.

2. Background Information

A conventional electrical relay includes a movable contact, which makes or breaks a conductive path between main terminals. Control terminals electrically connect to an actuator coil having a number of actuator coil windings. On many relays, the actuator coil has two separate windings or a partitioned winding used to actuate closure of separable main contacts, and to hold the separable main contacts together in a relay closed or on state. The need for the two coil windings is the result of the desire to minimize the amount of electrical coil power needed to maintain the relay in the closed state.

A typical normally open relay has a spring on its armature mechanism that holds the separable main contacts open. In order to initiate movement of the armature mechanism for closure, a relatively large magnetic field is generated to provide sufficient force to overcome the inertia of the armature mechanism and, also, to build up enough flux in the open air gap of a solenoid to create the desired closing force. During closure motion of the armature mechanism, both coil windings are energized to produce a sufficient magnetic field. After the main contacts close, the reluctance of the magnetic path in the solenoid is relatively small, and a relatively smaller coil current is needed to sustain the force needed to hold the main contacts together. At this point, an "economizer" or "cut-throat" circuit can be employed to de-energize one of the two coil windings to conserve power and to minimize heating in the solenoid.

There is room for improvement in electrical switching apparatus, such as relays.

SUMMARY

This need and others are met by embodiments of the disclosed concept which provide an electrical switching apparatus comprising: a ferromagnetic frame including a first portion and an opposite second portion, the opposite second portion having a first tapered portion thereon; a permanent magnet disposed on the first portion of the ferromagnetic frame; a ferromagnetic core disposed between the first portion and the opposite second portion of the ferromagnetic frame; a coil disposed about the ferromagnetic core; and a ferromagnetic or magnetic armature including a first portion, an opposite second portion and a pivot portion between the first portion and the opposite second portion of the ferromagnetic or magnetic armature, the opposite second portion of the ferromagnetic or magnetic armature having a second tapered portion therein, wherein the pivot portion is pivotally disposed on the ferromagnetic core, wherein the second tapered portion is complementary to the first tapered portion, wherein when the coil is de-energized the ferromagnetic or magnetic armature has a first position in which the first portion of the ferromagnetic or magnetic armature is magnetically attracted by the permanent magnet and the second tapered portion is moved apart from the first tapered portion, and wherein when the coil is energized the ferromagnetic or magnetic armature has a second position in which the opposite second portion of the ferromagnetic or magnetic armature is magnetically attracted by the opposite second portion of the ferromagnetic frame and the first tapered portion is moved into the second tapered portion.

BRIEF DESCRIPTION OF THE DRAWINGS

A full understanding of the disclosed concept can be gained from the following description of the preferred embodiments when read in conjunction with the accompanying drawings in which.

DESCRIPTION OF THE PREFERRED EMBODIMENTS

As employed herein, the term "number" shall mean one or an integer greater than one (i.e., a plurality).

As employed herein, the statement that two or more parts are "connected" or "coupled" together shall mean that the parts are joined together either directly or joined through one or more intermediate parts. Further, as employed herein, the statement that two or more parts are "attached" shall mean that the parts are joined together directly.

The disclosed concept is described in association with a bi-stable relay, although the disclosed concept is applicable to a wide range of electrical switching apparatus employing an armature or other suitable movable ferromagnetic or magnetic component.

Figure 1:
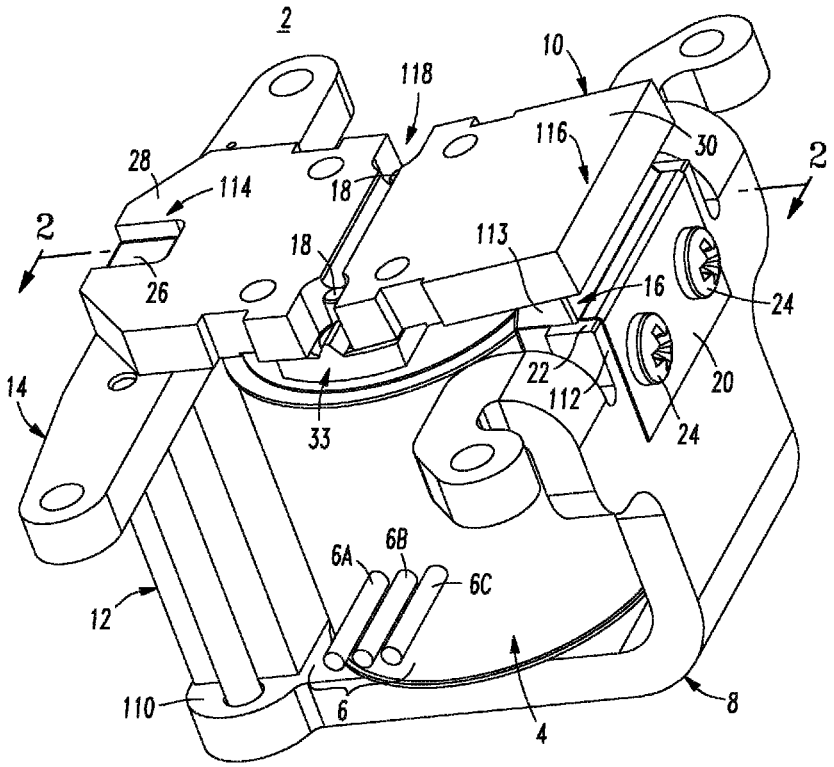
FIG. 1 is an isometric view of a relay in accordance with embodiments of the disclosed concept with some components not shown for ease of illustration.
Figure 3:
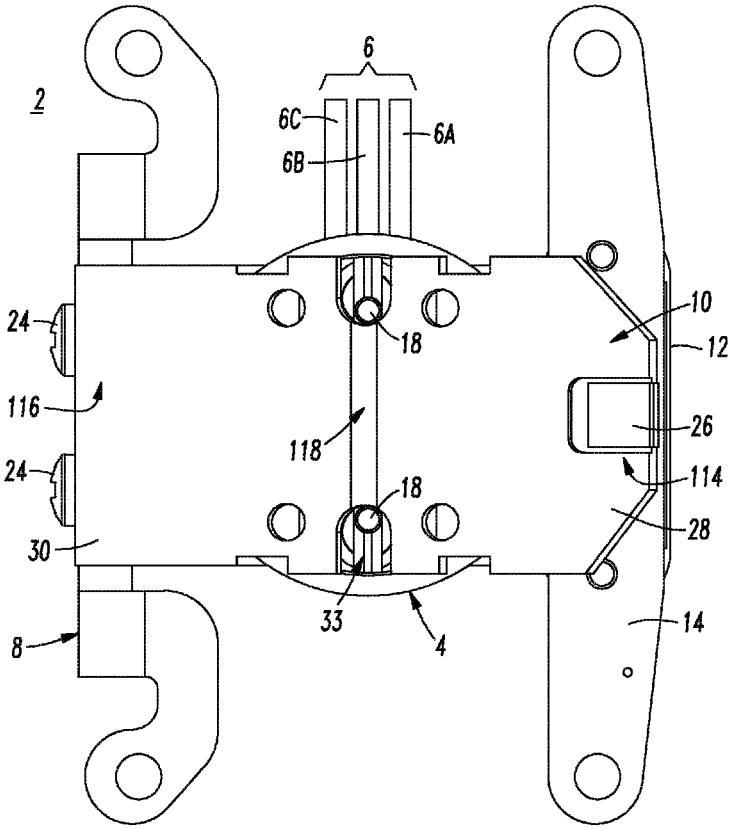
FIG. 3 is a top plan view of the relay of FIG. 1.

FIG. 1 shows a relay 2 with some components not shown for ease of illustration. The relay 2 includes an actuator coil 4 having leads 6, a ferromagnetic frame 8, a ferromagnetic armature 10, a permanent magnet 12, a pole piece 14, and a magnetic coupler 16. The armature 10 is pivotally mounted on the actuator coil 4 by guide pins 18 (two guide pins 18 are shown in FIGS. 1 and 3). The magnetic coupler 16 and a first air gap shim 20 are mounted to an end 22 of the ferromagnetic frame 8 by two example fillister head screws 24. Another air gap shim 26 is coupled to an end 28 of the armature 10. The example shims 20 and 26 are selectable components of the magnetic structure to allow control of the magnetic holding force and therefore the electrical response during magnetic release from the pole piece 14 or the tapered portion 113 of the magnetic coupler 16. These shims can be specifically characterized to meet functional electrical parameters for specific relay needs.

Figure 2:
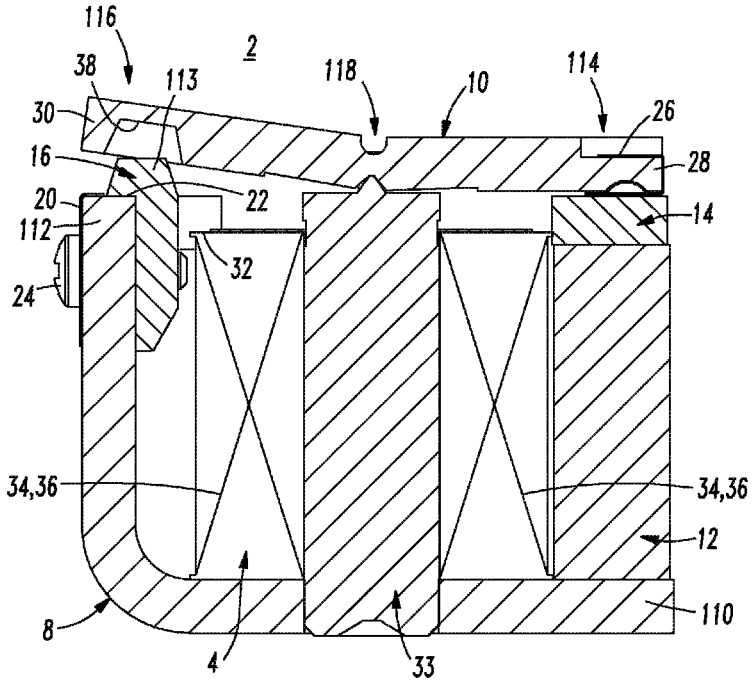
FIG. 2 is a vertical elevation sectional view along lines 2-2 of FIG. 1 with the relay in a de-energized position.

As is conventional, the actuator coil 4 includes a first coil winding 34 (shown in FIGS. 2 and 4), which functions as a hold coil and is terminated at leads 6A,6B, and a second winding 36 (shown in FIGS. 2 and 4), which functions as a close coil (for a normally open relay) and is terminated at leads 6B,6C. Although a specific example is shown, the two example coil windings 34,36 can be configured in a three lead or any other suitable configuration. FIG. 2 shows the relay 2 in a de-energized position in which the first and second coil windings 34,36 of the actuator coil 4 are both de-energized and the permanent magnet 12 magnetically attracts the end 28 of the armature 10 through the pole piece 14.

Figure 4:
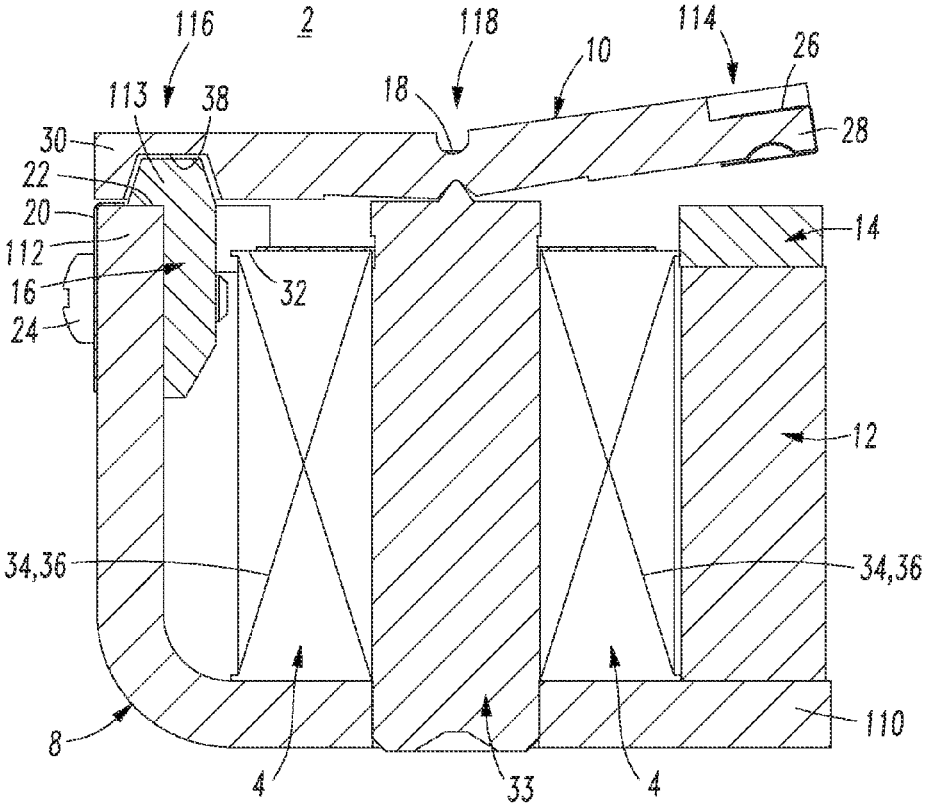
FIG. 4 is a vertical elevation sectional view similar to FIG. 2 except with the relay in an energized position.

FIG. 4 shows the relay 2 in an energized position in which coil windings 34,36 (shown in FIGS. 2 and 4) of the actuator coil 4 are energized and the magnetic coupler 16 magnetically attracts the opposite end 30 of the armature 10 through the ferromagnetic frame 8 and the magnetic field produced by the energized actuator coil 4.

As shown in FIGS. 2 and 4, the actuator coil 4 includes a core piece, such as a bobbin 32, about which the first and second coil windings 34,36 are wound, disposed about a ferromagnetic core 33.

Figure 5:
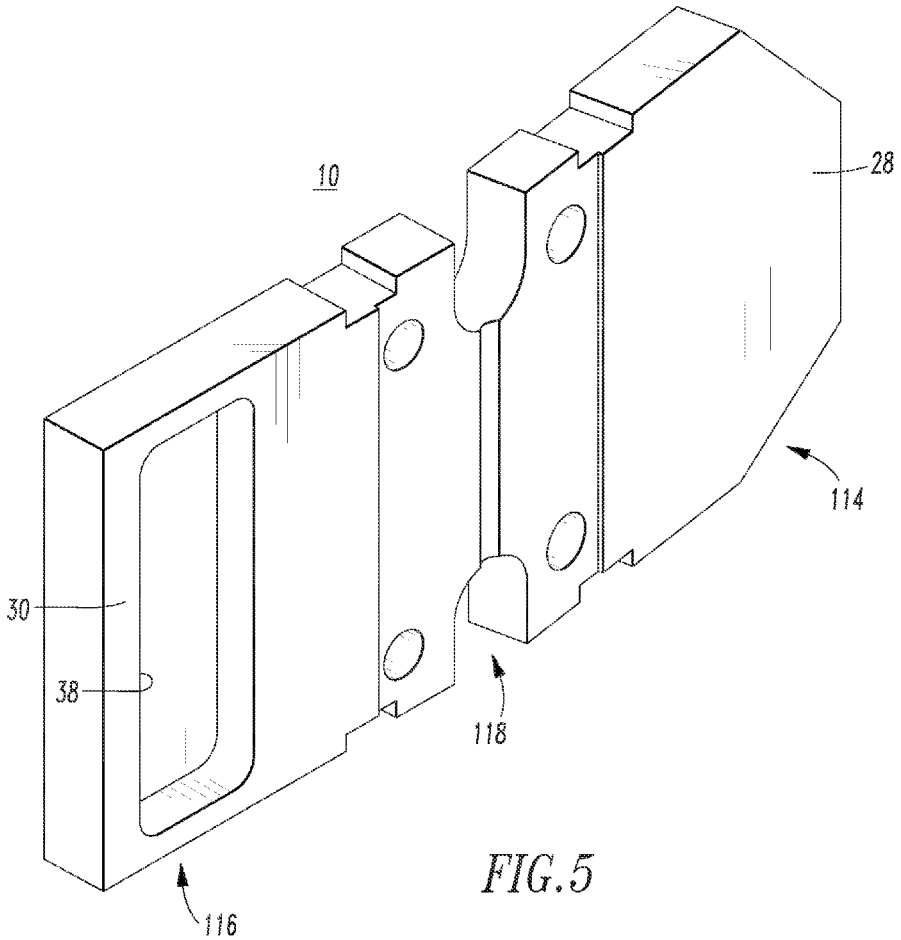
FIG. 5 is an isometric view of the armature of FIG. 1.

FIG. 5 shows the relay armature 10, which includes a tapered portion 38 at the end 30. As shown in FIGS. 1, 2, 4 and 5, the disclosed concept employs a tapered structure for both the stationary pole piece 16 and the movable armature 10. In a conventional relay (not shown), typically, flat ferromagnetic pieces are employed to provide a suitable holding force, however, this is not necessary for a magnetically held relay as compared to an electrically held relay. Therefore, by employing the tapered stationary pole piece 16 (best shown in FIGS. 1, 2 and 4) and the armature 10 having the tapered portion 38 (best shown in FIG. 5), which is complementary to the shape of the tapered stationary pole piece 16 for the magnetically held relay 2, which is magnetically held in one state and electro-magnetically held in the other state, the pickup voltage of the relay 2 is significantly lowered without compromising shock and vibration performance. The configuration of the tapered features of the armature 10 and the magnetic coupler 16 reduces the magnetic gap between the movable armature 10 and the tapered stationary pole piece 16 when in the position shown in FIG. 2.

The tapered portion 38 of the movable armature 10 and the tapered stationary pole piece 16 increase the surface area for magnetic lines of flux. This avoids the requirement for a (relatively highly) precision armature and pole piece in order to obtain suitable magnetic strength. The disclosed concept provides a relatively high pull-in strength, a relatively low pull-in or pickup voltage, or a combined/optimized increased pull-in strength and lowered pickup voltage. This provides a relatively low voltage needed to close the relay 2 (e.g., moving from the position of FIG. 2 to the position of FIG. 4), increased performance for relatively high temperature applications, or an optimized combination, since coil performance is reduced at relatively higher temperatures (due to increased resistance) such that improved magnetic performance is a key for relatively high temperature applications.

The additional surface area for magnetic lines of flux results in an additional magnetic flux path and, hence, relatively more force being applied to the teeter-totter armature 10 as can be seen in FIGS. 2 and 4. Alternatively, the functional temperature of the relay 2 can be increased without increasing the ampere turns of the coil windings 34,36, and/or without increasing the weight and size of the relay actuator coil 4.

Example 1

Figure 6:
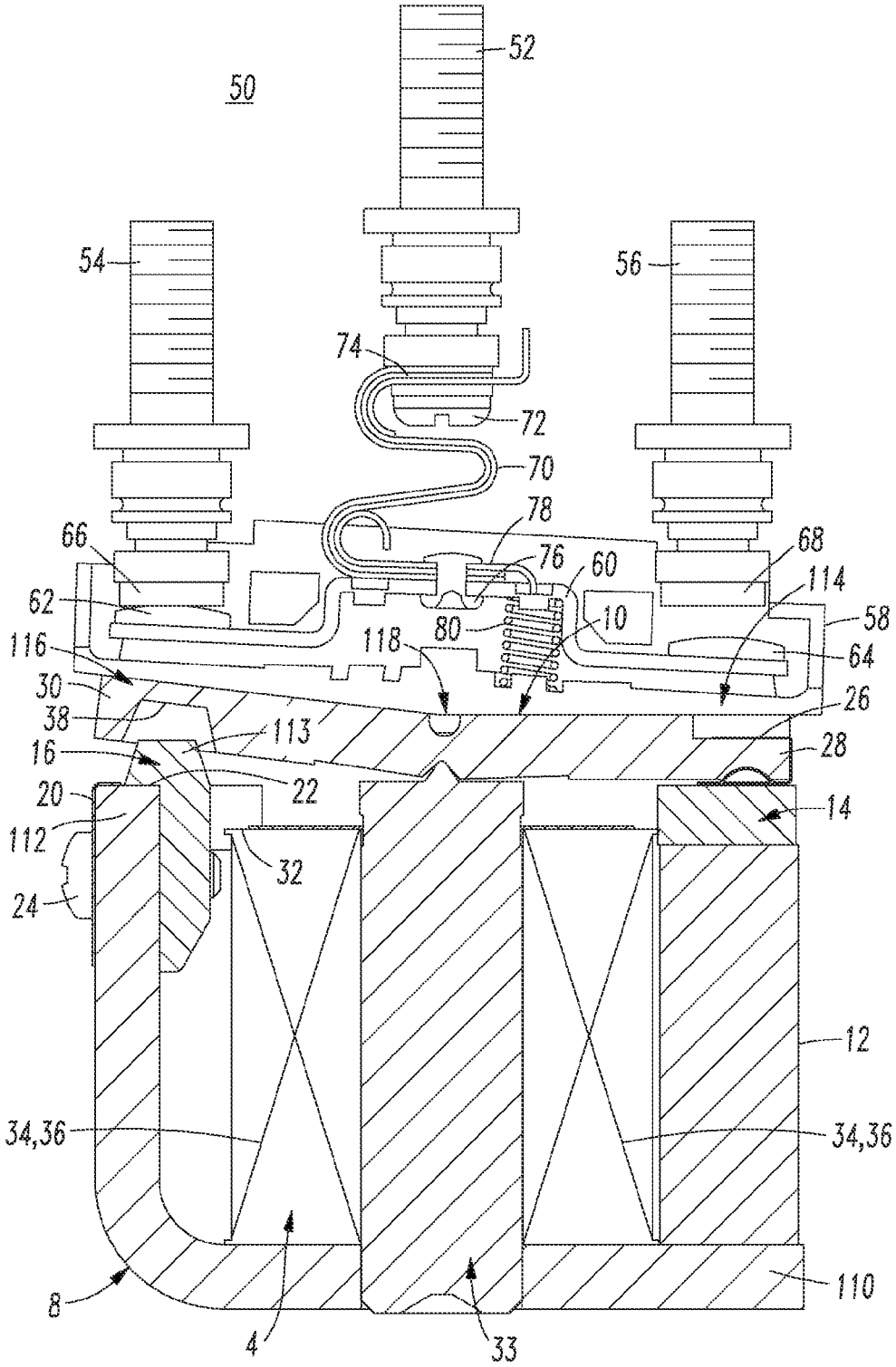
FIG. 6 is a vertical elevation sectional view of a double throw relay in accordance with an embodiment of the disclosed concept.

FIG. 6 shows a double throw relay 50 including the actuator coil 4, ferromagnetic frame 8, ferromagnetic armature 10, permanent magnet 12, pole piece 14 and magnetic coupler 16 of FIGS. 1-5. The relay 50 includes three terminals 52,54,56 for a line, a first load and a second load, respectively. Disposed above (with respect to FIG. 6) the armature 10 is a plastic carrier 58 and a movable contact carrier assembly 60 (e.g., without limitation, made of copper or beryllium). Two movable contacts 62,64 are disposed on the movable contact carrier assembly 60. Two fixed contacts 66,68 are disposed below (with respect to FIG. 6) the terminals 54,56, respectively. The movable contact 62 electrically and mechanically engages the fixed contact 66 in the position shown in FIG. 6 (corresponding to the position of the armature 10 shown in FIG. 2). In this position, the contacts 64,68 are magnetically held open by the magnet 12. The movable contact 64 electrically and mechanically engages the fixed contact 68 in a position (not shown) corresponding to the position of the armature 10 shown in FIG. 4. An internal foil 70 electrically connects the terminal 52 to the movable contact carrier assembly 60. A fastener 72 electrically and mechanically connects an end 74 of the foil 70 to the terminal 52, and a rivet 76 electrically and mechanically connects an opposite end 78 of the foil 70 to the movable contact carrier assembly 60. A balance spring 80 (e.g., without limitation, a reset balancer; a dampener) is coupled between the plastic carrier 58 and the movable contact carrier assembly 60.

As shown in FIG. 6, the relay 50 has a first current path from the central terminal 52 to the internal foil 70 to the movable contact carrier 60 to the first movable contact 62 to the normally closed stationary contact 66 and to the terminal 54. After the coil windings 34,36 (FIGS. 2 and 4) are energized, the armature 10 pivots (to the position shown in FIG. 4) and the current path changes. The second current path is from the central terminal 52 to the internal foil 70 to the movable contact carrier 60 to the second movable contact 64 to the normally open stationary contact 68 and to the terminal 56.

Example 2

A suitable "economizer" or "cut-throat" circuit (not shown) can be employed to de-energize one of the two example coil windings 34,36 (FIGS. 2 and 4) to conserve power and to minimize heating in the relay 2. The economizer circuit (not shown) is often implemented via an auxiliary relay contact (not shown) that is physically driven by the same mechanism (e.g., the armature 10, the plastic carrier 58 and the movable contact carrier assembly 60) as the main contacts (e.g., 62,66 and/or 64,68 of FIG. 6). The auxiliary relay contact simultaneously opens as the main contacts close, thereby confirming complete motion of the armature 10. The added complexity of the auxiliary relay contact and the calibration needed for the simultaneous operation makes this configuration relatively difficult and costly to manufacture.

Alternatively, the economizer circuit (not shown) can be implemented by a timing circuit (not shown) which pulses a second coil winding, such as 36, only for a predetermined period of time, proportional to the nominal armature operating duration, in response to a command for relay closure (e.g., a suitable voltage applied to the coil windings 34,36). While this eliminates the need for an auxiliary switch, it does not provide confirmation that the armature 10 has closed fully and is operating properly.

The economizer circuit (not shown) is a conventional control circuit that allows for a relatively much greater magnetic field in an electrical switching apparatus, such as the example relay 2, during, for instance, the initial (e.g., without limitation, 50 mS) time following application of power to ensure that the armature 10 completes it travel and overcomes its own inertia, friction and spring forces. This is achieved by using a dual coil arrangement in which there is a suitable relatively low resistance circuit or coil and a suitable relatively high resistance circuit or coil in series with the former coil. Initially, the economizer circuit allows current to flow through the low resistance circuit, but after a suitable time period, the economizer circuit turns off the low resistance path. This approach reduces the amount of power consumed during static states (e.g., relatively long periods of being energized).

Example 3

Figure 7:
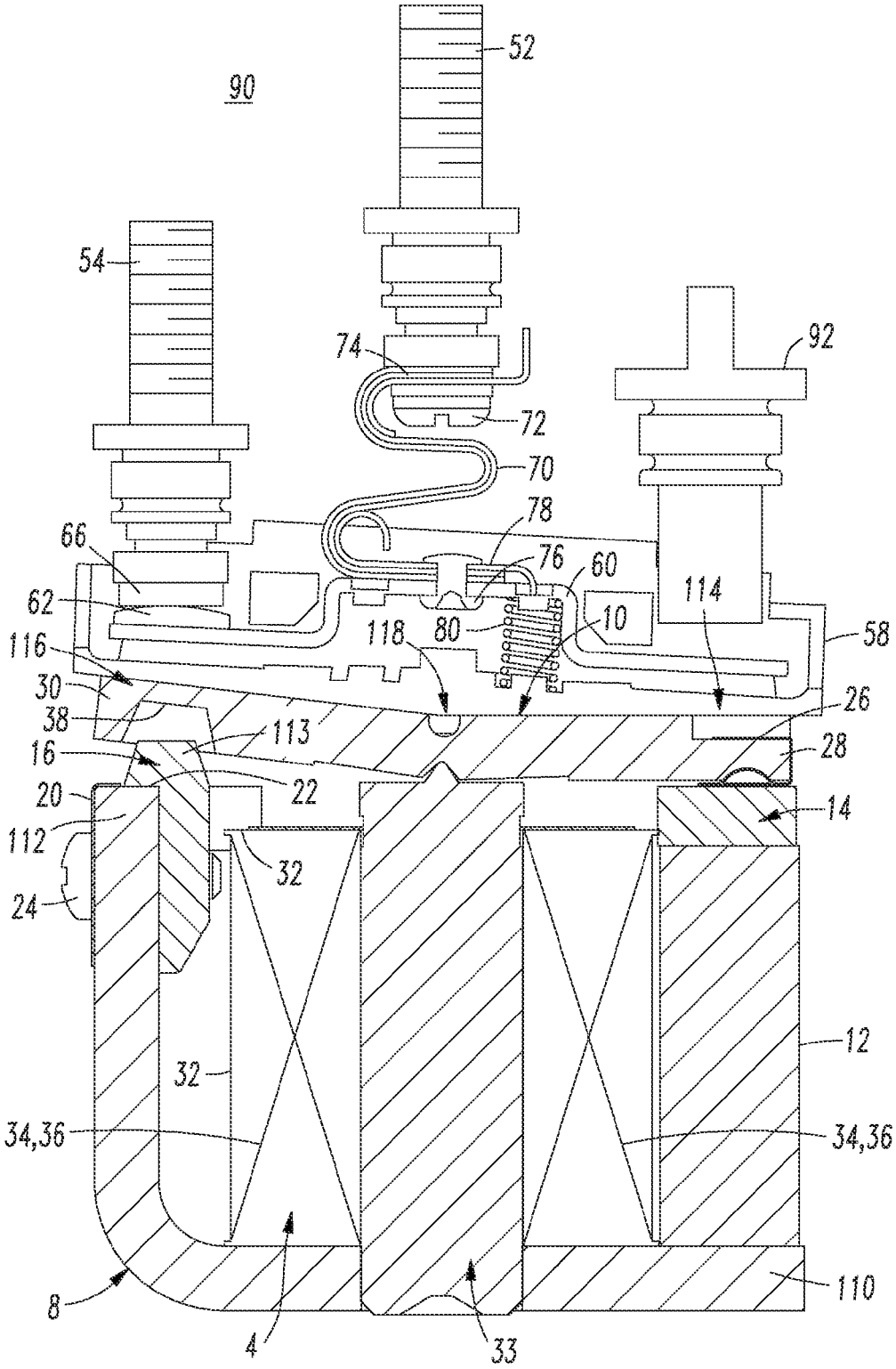
FIG. 7 is a vertical elevation sectional view of a single throw normally closed relay in accordance with an embodiment of the disclosed concept.

FIG. 7 shows a single throw normally closed relay 90 including the actuator coil 4, ferromagnetic frame 8, ferromagnetic armature 10, permanent magnet 12, pole piece 14 and magnetic coupler 16 of FIGS. 1-5. The relay 90 is substantially the same as the relay 50 of FIG. 6, except that it does not include the terminal 56 and the contacts 64,68, but does include a stop 92.

Example 4

Figure 8:
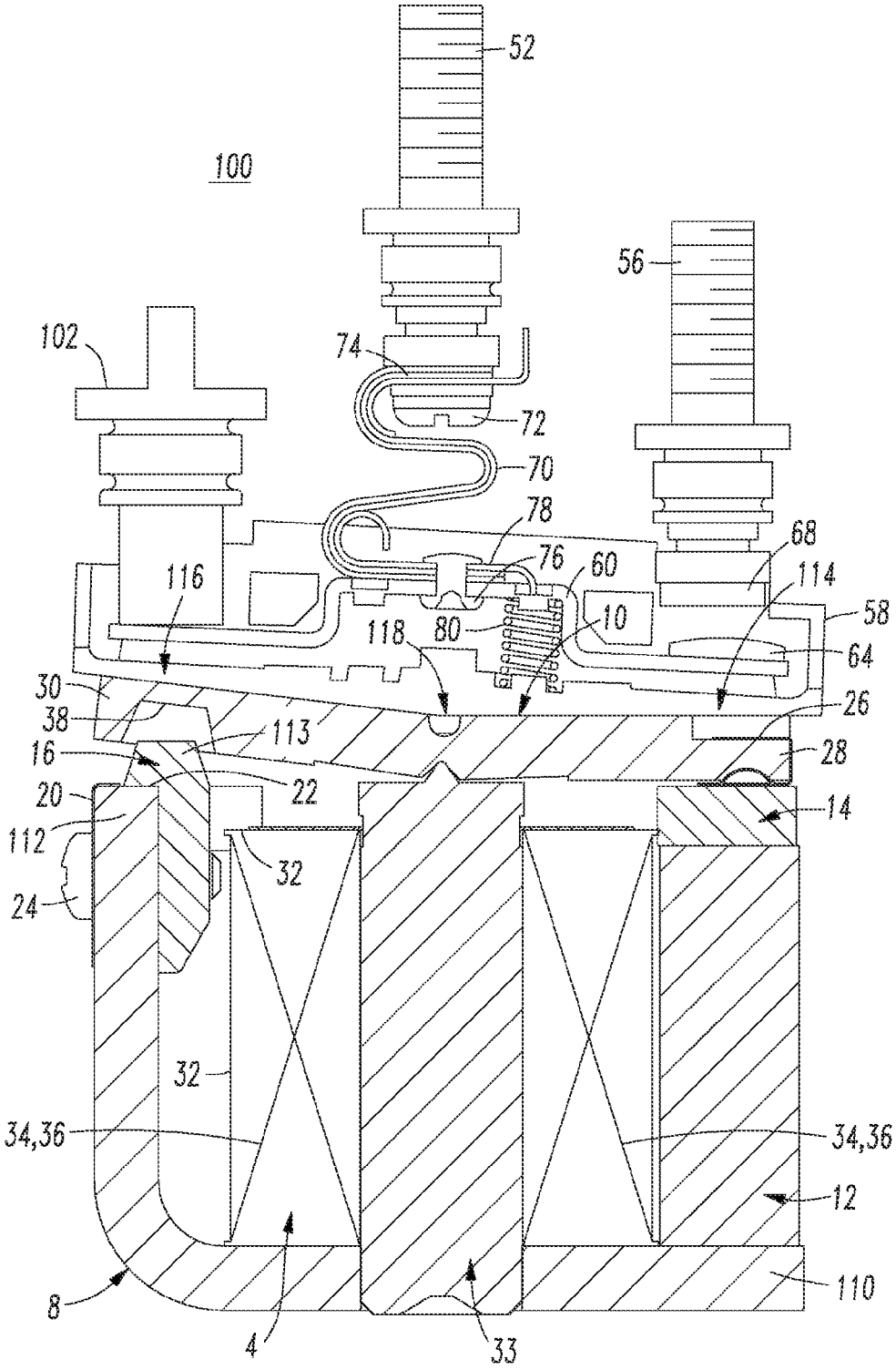
FIG. 8 is a vertical elevation sectional view of a single throw normally open relay in accordance with an embodiment of the disclosed concept.

FIG. 8 shows a single throw normally open relay 100 including the actuator coil 4, ferromagnetic frame 8, ferromagnetic armature 10, permanent magnet 12, pole piece 14 and magnetic coupler 16 of FIGS. 1-5. The relay 100 is substantially the same as the relay 50 of FIG. 6, except that it does not include the terminal 54 and the contacts 62,66, but does include a stop 102.

Example 5

The example relays 2,50,90,100 can operate at 115 VAC, 400 Hz, with 40 A motor loads. The line and load terminals 52,54,56 can accept up to a #10 AWG single conductor and employ a wire lug having 18 in-lb of torque.

Example 6

As can now be seen from FIGS. 1-5, the relay 2 includes the ferromagnetic frame 8, which has a general L-shape including a first portion 110 and an opposite second portion 112 having the magnetic coupler 16 forming a tapered portion 113 thereon. The permanent magnet 12 is disposed on the first portion 110 of the ferromagnetic frame 8. The ferromagnetic core 33 is disposed between the first portion 110 and the opposite second portion 112 of the ferromagnetic frame 8. The coil 4 is disposed about the ferromagnetic core 33. The ferromagnetic armature 10 includes the end 28 forming a first portion 114, the end 30 forming an opposite second portion 116 and a pivot portion 118 between the first portion 114 and the opposite second portion 116 of the ferromagnetic armature 10. The opposite second portion 116 of the ferromagnetic armature 10 has the concave tapered portion 38 therein as shown in FIG. 5. The pivot portion 118 is pivotally disposed on the ferromagnetic core 33. The tapered portion 38 is complementary to the convex tapered portion 113 formed by the magnetic coupler 16. When the coil 4 is de-energized, the ferromagnetic armature 10 has a first position (FIG. 2) in which the first portion 114 of the ferromagnetic armature 10 is magnetically attracted by the permanent magnet 12 and the tapered portion 38 is moved apart from the complementary tapered portion 113. When the coil 4 is energized, the ferromagnetic armature 10 has a second position (FIG. 4) in which the opposite second portion 116 of the ferromagnetic armature 10 is magnetically attracted by the opposite second portion 112 of the ferromagnetic frame 8 and in which the tapered portion 113 engages the tapered portion 38.

The pole piece 14 is disposed on the permanent magnet 12 between the permanent magnet 12 and the first portion 114 of the ferromagnetic armature 10 in the first position (FIG. 2). As can be seen from FIGS. 2 and 4, the armature 10 is a teeter-totter armature, which forms a suitable obtuse angle of less than 180 degrees and greater than 90 degrees between a first plane of the first portion 114 of the teeter-totter armature 10 and a second plane of the opposite second portion 116 of the teeter-totter armature 10. The magnetic coupler 16 is disposed on the opposite second portion 112 of the ferromagnetic frame 8 and has the tapered portion 113 thereon.

The disclosed concept provides the ferromagnetic armature 10 and stationary pole piece 16 for relatively lightweight bi-stable relays 2,50,90,100 suitable for use in a relatively high environmental stress environment. This lowers the pickup voltage (i.e., the voltage needed to transfer the relay from a de-energized state to an energized state) by about 25% to about 30% without increasing the relay weight and/or the coil force/size. This allows the relay to function in relatively very high temperature ambient environments (e.g., without limitation, greater than 85° C.) which typically is the maximum operating temperature for known relay technology.

A primary concern with operating relays at elevated temperatures is that the resistance of the coil increases appreciably to the degree that the source or line voltage is below the voltage needed to transfer the relay. The main advantages to a bi-stable relay are low power consumption (e.g., in the position of the armature 10 shown in FIG. 4) after switching, and superior shock resistance. In addition, the coil is only pulsed and the relay is magnetically held with a relatively smaller amount of hold current.

The disclosed concept employs a tapered configuration of both the stationary pole piece 16 and the movable armature 10. In conventional relays, typically, flat pieces are used for the greatest holding force; however, this is not necessary on a magnetically held relay as compared to an electrically held relay. Therefore, the disclosed tapered pole piece 16 and the disclosed tapered armature 10 for a magnetically held relay, the pickup voltage can be significantly lowered without compromising shock and vibration performance. The disclosed concept could be also used to further weight-reduce a relay with a relatively lower operating ambient temperature. This could be achieved by reducing the coil size, thereby reducing the overall mass of the relay.

While specific embodiments of the disclosed concept have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the disclosed concept which is to be given the full breadth of the claims appended and any and all equivalents thereof.

What is claimed is:

1. An electrical switching apparatus, comprising:

a ferromagnetic frame including a first portion and an opposite second portion;

a magnetic coupler disposed on the opposite second portion of said ferromagnetic frame, said magnetic coupler having a first tapered portion thereon;

a permanent magnet disposed on the first portion of said ferromagnetic frame;

a ferromagnetic core disposed between the first portion and the opposite second portion of said ferromagnetic frame;

a coil disposed about said ferromagnetic core; and a ferromagnetic or magnetic armature including a first portion, an opposite second portion and a pivot portion between the first portion and the opposite second portion of said ferromagnetic or magnetic armature, the opposite second portion of said ferromagnetic or magnetic armature having a second tapered portion therein, wherein the pivot portion is pivotally disposed on the ferromagnetic core, wherein the second tapered portion is complementary to the first tapered portion, wherein when said coil is de-energized said ferromagnetic or magnetic armature has a first position in which the first portion of said ferromagnetic or magnetic armature is magnetically attracted by said permanent magnet and the second tapered portion is moved apart from the first tapered portion, wherein when said coil is energized said ferromagnetic or magnetic armature has a second position in which the opposite second portion of said ferromagnetic or magnetic armature is magnetically attracted by the opposite second portion of said ferromagnetic frame and the first tapered portion is moved into the second tapered portion, and wherein the magnetic coupler and a first air gap shim are mounted to an end of the ferromagnetic frame by two screws.

2. The electrical switching apparatus of claim 1 wherein said electrical switching apparatus is a relay.

3. The electrical switching apparatus of claim 2 wherein said relay is a double throw relay.

4. The electrical switching apparatus of claim 2 wherein said relay is a single throw normally closed relay.

5. The electrical switching apparatus of claim 2 wherein said relay is a single throw normally open relay.

6. The electrical switching apparatus of claim 1 wherein a pole piece is disposed on said permanent magnet between said permanent magnet and the first portion of said ferromagnetic or magnetic armature in said first position.

7. The electrical switching apparatus of claim 1 wherein said ferromagnetic or magnetic armature is a teeter-totter armature.

8. The electrical switching apparatus of claim 7 wherein said teeter-totter armature forms an obtuse angle of less than 180 degrees and greater than 90 degrees between a first plane of the first portion of said teeter-totter armature and a second plane of the opposite second portion of said teeter-totter armature.

9. The electrical switching apparatus of claim 1 wherein said ferromagnetic frame has a general L-shape.

10. The electrical switching apparatus of claim 1 wherein the second tapered portion is a concave portion; and wherein the first tapered portion is a convex portion.

11. The electrical switching apparatus of claim 1 wherein the first tapered portion engages the second tapered portion in the second position.

12. The electrical switching apparatus of claim 1 wherein the magnetic coupler is disposed at least partially within the ferromagnetic frame.

13. The electrical switching apparatus of claim 1 wherein the magnetic coupler is disposed at least partially between the opposite second portion and the permanent magnet.

14. The electrical switching apparatus of claim 1 wherein the opposite second portion of the ferromagnetic frame is disposed between the magnetic coupler and the first air gap shim.

15. The electrical switching apparatus of claim 1 wherein the opposite second portion of the ferromagnetic frame defines a top surface that faces the opposite second portion of the ferromagnetic or magnetic armature when the ferromagnetic or magnetic armature is in the second position, and wherein the magnetic coupler and the first air gap shim directly contact the top surface of the opposite second portion of the ferromagnetic frame.

16. The electrical switching apparatus of claim 1 wherein the opposite second portion of the ferromagnetic frame defines an inner surface that faces the permanent magnet, and wherein the magnetic coupler directly contacts the inner surface of the opposite second portion of the ferromagnetic frame.

17. The electrical switching apparatus of claim 16 wherein the opposite second portion of the ferromagnetic frame defines an outer surface that is opposite the inner surface, and wherein the first air gap shim directly contacts the outer surface of the opposite second portion of the ferromagnetic frame.

* * * * *